United States Patent [19]

McTavish et al.

[11] Patent Number: 4,550,301

[45] **Date of Patent: * Oct. 29, 1985**

[54] PTC CIRCUIT PROTECTION DEVICE

[75] Inventors: Mary S. McTavish, Fremont; Robert W. Stodieck, Palo Alto; Frank A. Doljack, Pleasanton, all of Calif.

[73] Assignee: Raychem Corporation, Menlo Park, Calif.

[ * ] Notice: The portion of the term of this patent subsequent to Nov. 6, 2001 has been disclaimed.

[21] Appl. No.: 633,176

[22] Filed: Jul. 23, 1984

Related U.S. Application Data

[63] Continuation of Ser. No. 349,505, Feb. 17, 1982, Pat. No. 4,481,498.

[51] Int. Cl.[4] ..... H01C 1/00; H01C 7/02

[52] U.S. Cl. ..... 338/20; 338/276; 338/277; 338/22 R; 338/21; 219/505; 219/548; 361/106

[58] Field of Search ..... 338/20–23, 338/25, 276, 277, 226, 257; 219/548, 505, 540, 553; 361/103, 106

[56] References Cited

U.S. PATENT DOCUMENTS

| | | | |
|---|---|---|---|
| 3,037,266 | 6/1962 | Pfister | 338/226 X |
| 3,803,528 | 6/1972 | Wellard | 338/257 |
| 3,878,357 | 4/1975 | Marcoux | 219/505 |
| 4,101,862 | 7/1978 | Takagi et al. | 338/23 |
| 4,237,441 | 12/1982 | Van Konynenburg et al. | 338/22 |
| 4,238,812 | 12/1980 | Middleman et al. | 361/106 |
| 4,255,698 | 3/1981 | Simon | 320/35 |
| 4,282,003 | 8/1981 | Yashin et al. | 219/540 |
| 4,315,237 | 2/1982 | Middleman et al. | 338/22 |
| 4,317,027 | 2/1982 | Middleman et al. | 219/553 |
| 4,329,726 | 5/1982 | Middleman et al. | 361/58 |
| 4,331,861 | 5/1982 | Meixuer | 219/553 |
| 4,352,083 | 9/1982 | Middleman et al. | 338/23 |
| 4,413,301 | 11/1983 | Middleman et al. | 361/106 |
| 4,481,498 | 11/1984 | McTavish et al. | 338/21 X |

FOREIGN PATENT DOCUMENTS

| | | |
|---|---|---|
| 0040537 | 5/1981 | European Pat. Off. . |
| WO79/00737 | 10/1979 | PCT Int'l Appl. . |

*Primary Examiner*—Roy N. Envall, Jr.
*Assistant Examiner*—M. M. Lateef
*Attorney, Agent, or Firm*—Stephen C. Kaufman; Timothy H. P. Richardson; Herbert G. Burkard

[57] ABSTRACT

Circuit protection devices comprise a PTC conductive polymer element and means for minimizing the adverse effects of carbonaceous dust evolved by the PTC element when it is tripped. An enclosure encloses, but is spaced apart from, the PTC element. In one embodiment at least part of the interior surface of the enclosure is composed of polytetrafluoroethylene, a ceramic or another material which discourages the formation of permanent low resistance paths through carbonaceous material lying on its surface. In another embodiment the enclosure has a large internal surface area compared to the volume of the PTC element. In further embodiments, electrical leads are connected to and pass through the enclosure, and at least one of the leads is insulated along its length and/or the leads pass through opposite ends of the enclosure.

15 Claims, 4 Drawing Figures

PTC CIRCUIT PROTECTION DEVICE

CROSS REFERENCE TO RELATED APPLICATIONS

This application is a continuation of application Ser. No. 349,505, filed on Feb. 17, 1982, now U.S. Pat. No. 4,481,498 by McTavish et al and is related to Application Ser. Nos. 633,175 and 633,177 which are being filed contemporaneously with this application. The entire disclosures of each of these applications is incorporated by reference herein. Each of these applications is copending and commonly assigned.

FIELD OF THE INVENTION

This invention relates to circuit protection devices comprising PTC conductive polymer elements.

INTRODUCTION OF THE INVENTION

Conductive polymer compositions exhibiting PTC behavior, and electrical devices comprising them, are well known. Reference may be made, for example, to U.S. Pat. Nos. 2,952,761, 2,978,665, 3,243,753, 3,351,882, 3,571,777, 3,757,086, 3,793,716, 3,823,217, 3,858,144, 3,861,029, 4,017,715, 4,072,848, 4,085,286, 4,117,312, 4,177,376, 4,177,446, 4,188,276, 4,237,441, 4,242,573, 4,246,468, 4,250,400, 4,255,698 and 4,272,471, J. Applied Polymer Science 19, 813–815 (1975), Klason and Kubat; Polymer Engineering and Science 18, 649–653 (1978), Narkis et al; and commonly assigned U.S. Ser. Nos. 601,424 (Moyer), now abandoned, published as German OLS No. 2,634,999; 750,149 (Kamath et al), now abandoned, published as German OLS No. 2,755,077; 732,792 (Van Konynenburg et al), now abandond, published as German OLS No. 2,746,602; 751,095 (Toy et al), now abandoned, published as German OLS No. 2,755,076; 798,154 (Horsma et al), now abandoned, published as German OLS No. 2,821,799; 67,309 (Leary et al), now abandond, published as U.K. Application No. 2,059,155A, 98,711 (Middleman et al), now U.S. Pat. No. 4,315,237, 134,354 (Lutz) 141,984 (Gotcher et al), 141,987 (Middleman et al) 141,988 (Fouts et al), 141,989 (Evans), 141,991 (Fouts et al), 150,909 (Sopory), now U.S. Pat. No. 4,334,351, 150,910 (Sopory), 150,911 (Sopory), now U.S. Pat. No. 4,318,881, 174,136, (Cardinal et al), 176,300 (Jensen), now U.S. Pat. No. 4,330,704, 184,647 (Lutz), 250,491 (Jacobs et al), 254,352 (Taylor) and 272,854 (Stewart et al). The disclosure of each of the patents, publications and applications referred to above is incorporated herein by reference.

Particularly useful devices comprising PTC conductive polymers are circuit protection devices. Such devices have a relatively low resistance under the normal operating conditions of the circuit, but are "tripped", i.e. converted into a high resistence state, when a fault condition, e.g. excessive current or temperature, occurs. Such devices, and PTC conductive polymer compositions for use in them, are described for example in U.S. Pat. Nos. 4,237,441, 4,238,812, 4,255,698 and U.S. Pat. Application Ser. Nos. 98,711 now U.S. Pat. No. 4,315,237, 98,712 now U.S. Pat. No. 4,329,726, 141,987, 141,988, 141,989, 142,053 now U.S. Pat. No. 4,352,083, 142,054 now U.S. Pat. No. 4,317,027, 250,491 now abandoned and 254,352. In the practical use of such devices, it is usually necessary for them to comprise an enclosure around the conductive polymer element in order to electrically insulate and/or physically protect the element. The enclosure is preferably spaced apart from the element, and can also serve as an oxygen barrier.

The essential and the desired characteristics of a circuit protection device vary widely from one application to another, depending, for example, on the peak voltage, i.e. the voltage which is dropped across the device in its tripped condition, and the number of times which the device is expected to function. Ser. No. 141,987 discusses problems which can arise when PTC conductive polymer devices are used to protect circuits against very rapid increases in current, and in particular the increasing difficulty of providing effective protection as the peak current and/or the peak voltage increase. Ser. No. 141,987 points out that such problems appear to result from arc formation within the conductive polymer and that as the PTC element is repeatedly tripped, it becomes eroded in the vicinity of the hot zone so that it can ulitmately be divided in half by the erosion. Ser. No. 141,987 recommends the use of PTC compositions containing an arc-controlling additive, e.g. alumina trihydrate, which reduces the susceptibility of the PTC composition to form carbonaceous conductive paths, and the use of an oxygen barrier around the PTC element which is composed of a material which does not entrap any decomposition products of the PTC material resulting from arcing and which is not itself decomposed or damaged by arcing of the PTC element.

SUMMARY OF THE INVENTION

One characteristic which is always desired in a circuit protection device is that the device should "fail-safe", i.e. that when the device does fail, it fails in a high resistance state (including opening the circuit entirely). In tests carried out with the best of the prior art devices, comprising a PTC conductive polymer element and a spaced-apart enclosure, it was found that, when a batch of identically manufactured devices was tested at a peak voltage of about 240 volts or higher, the proportion which did not fail-safe (i.e. which failed in a low resistance state) was dependent on the peak voltage. Thus a significant (but at least for some purposes, acceptably small) proportion of the devices did not fail-safe at a peak voltage of 240 volts, and a much higher proportion did not fail-safe at a peak voltage of 600 volts DC. Investigations have shown that an important reason for the failure of devices comprising a PTC conductive polymer element and an enclosure around it is that when the PTC element is tripped, carbonaceous dust is ejected from the PTC element onto the interior surface of the enclosure, and that this dust can form a permanent low resistance conductive path between those parts of the device which are at a different potential during operation of the device. The present invention relates to means for minimizing the disadvantages resulting from the evolution of carbonaceous dust from a PTC conductive polymer element when it is tripped. Such means includes:

(1) Correlation of the size of the PTC element and the area of the surfaces within an enclosure surrounding the element (including the interior surface area of the enclosure itself), in order to minimize the thickness of the layer of carbonaceous dust on surfaces which could form part of an electrical short within the device.

(2) Selection of suitable materials for at least part of the interior surface of an enclosure surrounding the PTC element and/or for other surfaces which, when coated with carbon dust, could form part of an electrical short within the device.

(3) Means for ensuring an adequate distance (along surfaces which can become coated with carbonaceous dust) between non-insulated parts of the device which, if electrically connected, would cause shorting around the PTC element. Such means include the use of enclosures having exit ports for the leads which are relatively widely spaced from each other, e.g. at opposite ends of the enclosure, and the use of insulated leads.

(4) Selection of a suitable shape for the PTC element.

(5) Selection of the thermal transfer characteristics of those parts of the device which can become coated with carbon dust and which lie between non-insulated parts of the device which, if electrically connected, would cause shorting around the PTC element.

These expedients can of course be used in combination.

Through use of the present invention, it is possible to prepare circuit protection devices which fail-safe even at peak voltages of 600 volts or higher.

BRIEF DESCRIPTION OF THE DRAWING

The invention is illustrated in the accompanying drawing, in which.

DETAILED DESCRIPTION OF THE INVENTION

Figure 1:
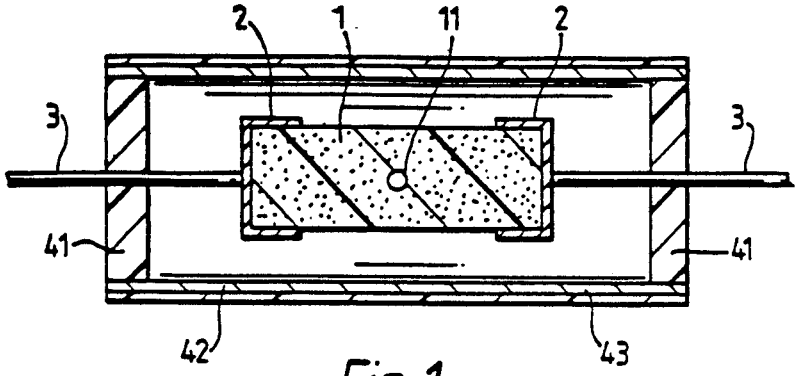
FIG. 1 is a cross-sectional through a preferred device of the invention.

In one aspect, the invention provides a circuit protection device which comprises (1) a PTC element composed of a conductive polymer composition which exhibits PTC behavior and which comprises a polymeric component and, dispersed in the polymeric component, a particulate conductive filler comprising carbon black;

(2) two electrodes which are electrically connected to the PTC element; and (3) an enclosure (a) which encloses and is spaced apart from at least the potential erosion zone of the PTC element;

(b) which is substantially impervious to carbon dust; and (c) at least a part of whose interior surface is composed of an insulating material which passes the carbon burn-off test at a test voltage of 440 volts DC, and preferably at a test voltage of 600 volts DC.

The carbon burn-off test just referred to is defined in detail later in the specification. The "potential erosion zone" of a PTC element is, in general terms, the part of a PTC element which is subject to erosion when the device is tripped, and is defined herein as that part of the PTC element which has the hot zone at its center and whose volume is three times the volume of the hot zone, the hot zone being defined as that part of the PTC element which, when the device has been tripped by passing a fault current through it, has been converted into a zone of high temperature and high resistance such that 90% of the peak voltage, (i.e. the total voltage dropped over the device as a whole) is dropped over that zone.

In another aspect, the invention provides a circuit protection device which comprises (1) a PTC element composed of a conductive-polymer composition which exhibits PTC behavior and which comprises a polymeric component and, dispersed in the polymeric component, a particulate conductive filler comprising carbon black;

(2) two electrodes which are electrically connected to the PTC element and which are connectable to a source of electrical power to cause current to pass through the PTC element; and (3) an enclosure which (a) encloses and is spaced apart from at least the potential erosion zone of the PTC element; and (b) is substantially impervious to carbon dust;

the ratio $V_1/A_1$ being less than 0.0025 inch, preferably less than 0.002 inch, particularly less than 0.001 inch, where $V_1$ is the volume in cubic inches of the potential erosion zone of the PTC element and $A_1$ is the area in square inches of the surfaces within the enclosure which do not carry current during normal operation of the device (i.e. the area of the internal surface of the enclosure, plus the surface area of any additional surfaces). The ratio of the exposed surface area of the potential erosion zone of the PTC element to the area $A_1$ is preferably less than 0.08, especially less than 0.04.

In another aspect, the invention provides a circuit protection device which comprises (1) a PTC element composed of a conductive polymer composition which exhibits PTC behavior and which comprises a polymeric component and, dispersed in the polymeric component, a particulate conductive filler comprising carbon black;

(2) two electrodes which are electrically connected to the PTC element and which are connectable to a source of electrical power to cause current to pass through the PTC element; and (3) an enclosure which (a) encloses and is spaced apart from the whole of the PTC element; and (b) is substantially impervious to carbon dust;

the ratio $V_2/A_1$ being less than 0.008 inch, preferably less than 0.007 inch, especially less then 0.006 inch, particularly less than 0.003 inch, where $V_2$ is the volume in cubic inches of the PTC element and $A_1$ is the area in square inches of the surfaces within the enclosure which do not carry current during normal operation of the device. Preferably the ratio of the exposed surface area of the PTC element to the area $A_1$ is less than 0.2, particularly less than 0.10.

In the two aspects of the invention just described, the ratios $V_1/A_1$ and $V_2/A_1$ are a measure of the thickness of the layer of carbonaceous dust deposited on the surfaces.

In another aspect, the invention provides a circuit protection device which has a resistance of less than 1000 ohms and which comprises (1) a PTC element which (a) is composed of a PTC conductive polymer composition which has a resistivity at 23° C. of less than 100 ohm.cm and which comprises a polymeric component and, dispersed in the polymeric component, a particulate conductive filler comprising carbon black; and (b) is in the form of a strip whose length is greater than the largest cross-sectional dimension of the strip;

(2) two electrodes which are electrically connected to opposite ends of the PTC element; and (3) an enclosure which (a) surrounds but is spaced apart from at least the potential erosion zone of the PTC element; and (b) is substantially impervious to carbon dust.

Preferably the device also comprises two electrical leads, one connected to each electrode, and the enclosure (a) encloses and is spaced apart from the whole of the PTC element;

(b) is electrically insulated from the PTC element, the electrodes and the leads; and (c) is in the shape of a tube with closed ends, the axis of the tube and the axis of the PTC element being substantially the same, and the closed ends comprising exit ports through which the leads pass.

In another aspect, the invention provides a circuit protection device which has a resistance of less than 1000 ohms and which comprises (1) a PTC element which (a) is composed of a PTC conductive polymer composition which has a resistivity at 23° C. of less than 100 ohm.cm and which comprises a polymeric component and, dispersed in the polymeric component, a particulate conductive filler comprising carbon black; and (b) is in the form of a strip with substantially planar parallel ends, the length of the strip being greater than the largest cross-sectional dimension of the strip;

and (2) two electrodes, each in the form of a cap having (i) a substantially planar end which contacts and has substantially the same cross-section as one end of the PTC element and (ii) a side wall which contacts the side of the PTC element.

In another aspect, the invention provides a circuit protection device which comprises (1) a PTC element composed of a conductive polymer composition which exhibits PTC behavior and which comprises a polymeric component and, dispersed in the polymeric component, a particulate conductive filler comprising carbon black;

(2) two electrodes which are electrically connected to the PTC element;

(3) two electrical leads, one connected to each electrode, which are connectable to a source of electrical power to cause current to pass through the PTC element; and (4) an enclosure which (a) encloses, is spaced apart from and is insulated from the electrical leads, the electrodes and the whole of the PTC element;

(b) is substantially impervious to carbon dust; and (c) comprises two exit ports through each of which passes one of the electrical leads;

at least one of said electrical leads being electrically insulated over at least a substantial proportion of its length from the exit port through which it passes towards the electrode to which it is connected. Preferably one or both of the leads is insulated over substantially the whole of its length between its exit port and its electrode.

In another aspect, the invention provides an electrical circuit which comprises (a) a power source having a voltage V which is at least 440 volts DC;

(b) an electrical load; and (c) a circuit protection device which comprises (1) a PTC element composed of a conductive polymer composition which exhibits PTC behavior and which comprises a polymeric component and, dispersed in the polymeric component, a particulate conductive filler comprising carbon black;

(2) two electrodes which are electrically connected to the PTC element and which are connectable to a source of electrical power to cause current to pass through the PTC element; and (3) an enclosure (a) which encloses and is spaced apart from at least the potential erosion zone of the PTC element;

(b) which is substantially impervious to carbon dust; and (c) at least a part of whose interior surface is composed of an insulating material which passes the carbon burn-off test at a test voltage of V volts.

The devices of the invention generally comprise an enclosure which encloses and is spaced-apart from the potential erosion zone of the PTC element, and it is usually convenient for the enclosure to enclose and be spaced apart from the whole of the PTC element. The enclosure must not of course provide a current path between the two electrodes, and generally therefore, consists at least in part of insulating material. Often it is convenient for the device to include electrical leads connected to (or intergrally formed with) the electrodes, with the leads passing through exit ports in the enclosure, so that the enclosure encloses and is spaced apart from the electrodes and the PTC element. Under these circmstances, it is preferred that at least one of the parts of the enclosure defining an exit port is composed of insulating material and/or that one or both of the leads should be insulated.

It is also possible for one or both of the electrodes to form part of the enclosure. Under these circumstances, it is preferred that each part of the enclosure contiguous with an electrode is made of insulating material.

We have found that the nature of the interior surfaces of the device can play an important part in determining the likelihood that a device will fail in the low resistance state. In particular we have found that the surfaces which can become coated with carbon dust from the PTC element, and can thus provide a path for a short circuit, are preferably composed of at least in part a material which will pass the "Carbon Burn-Off Test" described below. Thus it is preferred that at least part of the interior surface of the enclosure should be composed of such a material, especially, of course, those parts which provide the shortest distance (along the surface) between parts of the device which are at a different potential during operation of the device. It is also preferred that, when the device comprises one or two leads within the enclosure, at least one lead should be insulated with a material which passes the carbon burn-off test and/or at least one of the exit ports in the enclosure should be defined by a part of the enclosure which is composed of such a material.

THE CARBON BURN-OFF TEST

Figure 3:
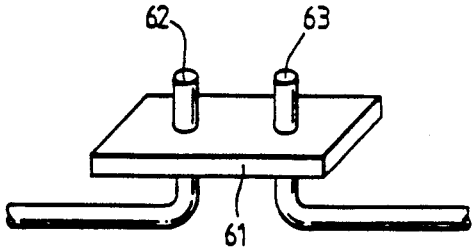
FIG. 3 is an isometric view of a test sample for use in the carbon burn-off test described below.
Figure 4:
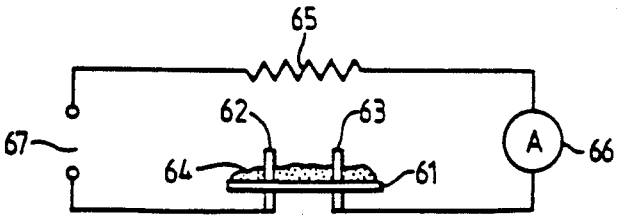
FIG. 4 is a circuit diagram for the circuit used in the carbon burn-off test described below.

There is prepared a self-supporting rectangular plaque of the material, having a thickness of at least 0.04 inch and a planar upper surface 0.25 inch and at least 0.5 inch long. Two holes are drilled through the plaque at right angles to the planar upper surface, the centers of the holes being 0.25 inch apart and 0.125 inch or more from each edge of the plaque, and the diameter of each hole being just large enough to accomodate a 20 gauge wire. A solid copper wire of 20 gauge is pushed through each hole so that it protrudes 0.25 inch above the planar surface. A typical test sample preferred in this way is shown in FIG. 3 and comprises plaque 61 having wires 62 and 63 pushed therethrough. A circuit as shown in FIG. 4 is then made, with the copper wires 62 and 63 connected in series with a fixed resistor 65, an ammeter 66 and a variable voltage power supply 67. With the planar surface horizontal, carbon black is dusted onto the surface until no more will stay on, as shown by 64 in FIG. 4. The voltage is then increased from zero to the test voltage at a rate of about 10 volts per second. Sometimes, as the voltage is increased, an arc is struck between the wires above the planar surface, blowing off some of the carbon black; if that happens, the voltage is reduced to zero and carbon black is again powdered onto the surface before repeating the test. After the voltage has been increased to the test voltage, it is maintained at that level until a stable condition is reached, before being reduced to zero to complete the test.

Plaques made of preferred materials will not burn, melt or distort when subjected to the carbon burn-off test, and such materials are described in this specification as "materials which will pass the carbon burn-off test". It is particularly preferred to use materials which, when subjected to the carbon burn-off test, not only pass the test but also result in a current in the test circuit which is below 0.005 amp at the end of the test.

The ability of a particular material to pass the carbon burn-off test at voltages above about 240 volts is dependent on the test voltage employed in the test, and to a lesser extent on whether the power source is a DC or AC power source (voltages given in this specification are RMS values for AC power sources). In tests using a 600 volt DC test voltage, we have found that polytetrafluoroethylene ("Teflon" sold by E. I. du Pont de Nemours) and various ceramics pass the carbon burn-off test, whereas poly(methyl methacrylate) ("Plexiglass"), polycarbonates ("Lexan"), acetal resins ("Delrin"), commericial glass, borosilicate glass, epoxy resins, and phenolic-resin-impregnated paper do not pass the test. Insulating materials which have previously been used to provide at least a part of the interior surface of an enclosure for a PTC conductive polymer element in a circuit protection device are epoxy resins (e.g. Hysol epoxy resin EE 0149) and conventional glass; these materials fail the carbon burn-off test at a voltage of 440 volts DC.

In order to ensure that the device will fail in the high resistance state, the test voltage used in the carbon burn-off test should be at least as high as the voltage dropped over the device in the fault condition. We have carried out the test using Raven 8000 as the carbon black, but we believe that the results are not dependent on the carbon black used.

The enclosures used in the present invention insulate and physically protect the PTC element; in addition they also prevent carbonaceous dust evolved from the PTC element from being deposited on adjacent articles (especially electrically active articles which might be undesirably changed by such deposition). When carbonaceous dust is evolved from the PTC element, gaseous decomposition products are generally evolved at the same time. If not released, such gases can create undesirably high pressures within the enclosure; accordingly it is preferred that the enclosure is pervious to gases which are generated within it.

While the thermal transfer characteristics of the device are not generally as important as the nature of the internal surfaces and their area, their effect on the likelihood of low resistance failure can be significant. We have found that by heat-sinking a part of the device which is coated with carbon dust, the likelihood of a short being formed through that carbon dust can be increased. Conversely, if the part is very well insulated, the likelihood of a short is reduced.

The circuit protection devices of the invention usually have a resistance of less than 1000 ohms, often less than 100 ohms, particularly less then 50 ohms.

The PTC elements of the invention are preferably composed of a conductive polymer composition which has a resistivity at 23° C. of less than 100 ohm.cm, particularly less than 50 ohm.cm, especially less than 10 ohm.cm. Suitable compositions are disclosed in the documents incorporated by reference herein; preferably they comprise an arc-controlling additive, e.g. a hydrated metal oxide.

The PTC element can be in the form of a strip whose length is greater than its largest cross-sectional dimension, especially one obtained by cutting a short length from a melt-extruded strip. When using such an element, the electrodes are preferably electrically connected to opposite ends of the strip. The electrodes generally contact the PTC element directly but can be electrically connected to it through another element, e.g. a ZTC conductive polymer element. The PTC element can be of generally cylindrical shape, but strips of non-circular cross-section can also be used. Preferably the PTC element includes means for inducing the formation of the hot zone away from the electrodes, as disclosed in the documents incorporated by reference herein.

The electrodes used in this invention can be of any suitable configuration, including planar and columnar electrodes; a planar electrodes can cover all or part of the cross-section of the PTC element. Preferred electrodes for use with strip-like PTC elements as described above are in the form of a cap having (i) a substantially planar end which contacts and has substantially the same cross-section as one end of the PTC element and (ii) a side wall which contacts the side of the PTC element.

In the circuits of the invention, the supply voltage is at least 240 volts, e.g. at least 360 volts or at least 440 volts. The invention also includes circuits in which the supply voltage is less than 240 volts, e.g. 50–140 volts DC, but the expected fault condition will result in a peak voltage across the device of at least 240 volts.

Referring now to FIG. 1 of the drawing, this illustrates in cross-section a circuit protection device of the invention which comprises a cylindrical PTC element 1 having a hole 11 drilled through it to induce formation of the hot zone in the center of the element. Fitted to the ends of PTC element 1 are cap electrodes 2 having leads 3 secured thereto. Insulating discs 41 are fitted over the leads 3 and are themselves fitted within a cylindrical metal tube having an external covering of insulating tape 43.

Figure 2:
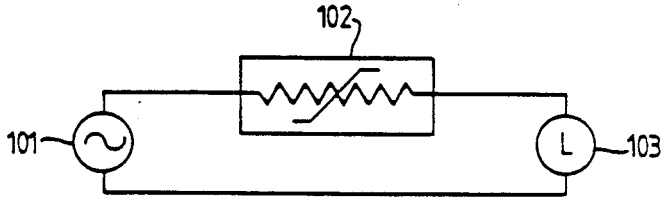
FIG. 2 is a circuit diagram for a circuit of the invention.

Referring now to FIG. 2, this shows a circuit of the invention comprising a power source 101, a circuit protection device 102 and an electrical load 103 in series therewith.

The invention is illustrated by the following Example.

EXAMPLE

A circuit protection device as illustrated in FIG. 1 was prepared as follows.

A granulated conductive polyner composition was prepared by the procedure given in the Example of Ser. No. 141,987. It contained, by volume, about 54.7% of high density polyethylene, about 26.9% of carbon black (Furnex N765), about 16.5% of alumina trihydrate and about 1.9% of antioxidant. The granulated composition was melt-extruded as a rod of diameter 0.128 inch. The rod was cut into PTC elements 0.345 inch long and a hole 0.025 inch in diameter was drilled radially through the center of each element. Each element was irradiated to about 40 Mrad and then annealed. The electrode caps, having 22 AWG leads secured thereto and being 0.125 inch in internal diameter and 0.1 inch deep, were press-fitted and crimped over the ends of the PTC element.

The PTC element and the electrodes were placed within a cylindrical shell comprising a metal cylinder (0.25 inch inner diameter and 0.75 inch long) and polyester/acrylic adhesive tape wrapped around the metal cylinder. Polytetrafluoroethylene end caps, with central 22 AWG holes in them and having an outer diameter of 0.25 inch, were fitted over the leads and press-fitted into the cylindrical shell, which was then crimped around them.

The device as described above was found to fail safe when tested at a peak voltage of 600 volts AC.

We claim:

1. A circuit protection device which comprises (1) a PTC element composed of a conductive polymer composition which exhibits PTC behavior and which comprises a polymeric component and, dispersed in the polymeric component, a particulate conductive filler comprising carbon black;

(2) two electrodes which are electrically connected to the PTC element and which are connectable to a source of electrical power to cause current to pass through the PTC element; and (3) an enclosure (a) which encloses and is spaced apart from at least the potential erosion zone of the PTC element;

(b) which is substantially impervious to carbon dust; and (c) at least a part of whose interior surface is composed of an unsulating material which passes the carbon burn-off test at a test voltage of 440 volts DC, whereby the adverse effects of carbonaceous dust evolved by the PTC element when it is tripped are minimized.

2. A device according to claim 1 wherein said insulating material passes the carbon burn-off test at a test voltage of 600 volts DC.

3. A device according to claim 1 wherein the enclosure encloses and is spaced apart from the whole of the PTC element.

4. A device according to claim 1 which further comprises at least one electrical lead which (a) is connected to one of the electrodes, (b) passes through an exit port in the enclosure, and (c) is electrically insulated from the enclosure.

5. A device according to claim 1 which further comprises two electrical leads, one connected to each electrode, and wherein the enclosure (a) is electrically insulated from the PTC element, the electrodes and the leads and (b) comprises exit ports through which the leads pass.

6. A device according to claim 5 wherein the interior surface of the enclosure around each of the exit ports is composed of a said insulating material.

7. A device according to claim 1 wherein said insulating material is selected from polytetrafluoroethylene and ceramics.

8. A device according to claim 1 wherein said enclosure is pervious to any gases which are generated within it when the PTC element is converted to a high resistance state.

9. An electrical circuit which comprises (a) a power source having a voltage V which is at least 440 volts DC;

(b) an electrical load; and (c) a circuit protection device which comprises (1) a PTC element composed of a conductive polmyer composition which exhibits PTC behavior and which comprises a polymeric component and, dispersed in the polymeric component, a particulate conductive filler comprising carbon black;

(2) two electrodes which are electrically connected to the PTC element and which are connectable to a source of electrical power to cause current to pass through the PTC element; and (3) an enclosure

3 (a) which encloses and is spaced apart from at least the potential erosion zone of the PTC element;

(b) which is substantially impervious to carbon dust; and (c) at least a part of whose interior surface is composed of an insulating material which passes the carbon burn-off test at a test voltage of V volts, whereby the adverse effects of carbonaceous dust evolved by the PTC element when it it tripped are minimized.

10. A circuit according to claim 9, wherein the enclosure encloses and is spaced apart from the whole of the PTC element.

11. A circuit according to claim 9, which further comprises at least one electrical lead which (a) is connected to one of the electrodes, (b) passes through an exit port in the enclosure, and (c) is electrically insulated from the enclosure.

12. A circuit according to claim 9 which further comprises two electrical leads, one connected to each electrode, and wherein the enclosure (a) is electrically insulated from the PTC element, the electrodes and the leads and (b) comprises exit ports through which the leads pass.

13. A circuit according to claim 12 wherein the interior surface of the enclosure around each of the exit ports is composed of said insulating material.

14. A device according to claim 9 wherein said insulating material is selected from polytetrafluoroethylene and ceramics.

15. A circuit according to claim 9 wherein said enclosure is pervious to any gases which are generated within it when the PTC element is converted to a high resistance state.

* * * * *